US008452042B2

(12) United States Patent
Diedrich et al.

(10) Patent No.: US 8,452,042 B2
(45) Date of Patent: May 28, 2013

(54) SHALLOW SPEAKER

(75) Inventors: Brad Michael Diedrich, Oregon, WI (US); Chad Aarron Kautz, Lena, IL (US); Alan Robert Cross, Monroe, WI (US)

(73) Assignee: Mitek Corporation, Phoenix, AZ (US)

( * ) Notice: Subject to any disclaimer, the term of this patent is extended or adjusted under 35 U.S.C. 154(b) by 44 days.

(21) Appl. No.: 13/078,993

(22) Filed: Apr. 3, 2011

(65) Prior Publication Data

US 2012/0250931 A1 Oct. 4, 2012

(51) Int. Cl.
*H04R 1/00* (2006.01)
*H04R 9/06* (2006.01)
*H04R 11/02* (2006.01)

(52) U.S. Cl.
USPC ..... 381/433; 381/404

(58) Field of Classification Search
USPC ..... 381/404, 433
See application file for complete search history.

(56) References Cited

U.S. PATENT DOCUMENTS 5,903,656 A * 5/1999 D'Hoogh et al. ..... 381/333
6,095,280 A 8/2000 Proni
7,155,021 B2 12/2006 Corynen
7,433,485 B1 * 10/2008 Diedrich et al. ..... 381/404
7,515,728 B2 4/2009 Kobayashi et al.
7,599,511 B2 10/2009 Corynen
2005/0117772 A1 6/2005 Chang
2005/0185816 A1 * 8/2005 Roark et al. ..... 381/400
2006/0171557 A1 8/2006 Chan
2006/0182302 A1 * 8/2006 Onodera ..... 381/397
2011/0222721 A1 * 9/2011 Matsuda et al. ..... 381/412

* cited by examiner

*Primary Examiner* — Brian Ensey
*Assistant Examiner* — Katherine Faley
(74) *Attorney, Agent, or Firm* — Keith L. Jenkins, Registered Patent Attorney, LLC; Keith L. Jenkins

(57) ABSTRACT

An improved shallow speaker is disclosed having a molded diaphragm with an outer, depending, annular cylindrical subcone that connects to a channel formed in the outer perimeter of the spider. Embodiments for round and cornered (polygonal, etc.) speakers are provided. The top plate has a raised outer annular portion for receiving an annular spider flange with or without screw holes for clamping the inner spider flange with a spider ring. In the cornered speaker embodiments, flanges extend from the cylindrical portions to the cornered portions including from a diaphragm inner glue flange over the depressed central portion and from the annular cylindrical subcone both outwardly and inwardly to top diaphragm portions. Routing of the tinsel may be through one or more openings in the annular cylindrical subcone and along the diaphragm inner surfaces, with channels in or on those surfaces for securely routing the tinsel.

20 Claims, 13 Drawing Sheets

SHALLOW SPEAKER

RELATED APPLICATIONS

This application is related to U.S. Pat. No. 7,433,485 to at least one of the same inventors as the present application, and to U.S. Pat. No. 7,275,620 to at least one of the same inventors as the present application, the contents of which are incorporated herein by reference.

FIELD OF THE INVENTION

The present invention relates to improvements in shallow loudspeakers, particularly loudspeakers in the low-frequency audible range (woofers and sub-woofers). More particularly, the present invention relates to a improvements in speaker design for maintaining the excursion capability of the speaker while reducing its depth dimension.

BACKGROUND OF THE INVENTION

A conventional loudspeaker, or "speaker", as used herein, may use a moveable cone, or "diaphragm" to produce sound. Some diaphragms have radially symmetrical curvature, but may have shape variations (some are almost flat) that vary the geometry of the diaphragm from a strict geometric cone. The diaphragm is moved by a former, which also supports the voice coil. The former is attached to the diaphragm. The voice coil, which rests in the magnetic field of a magnet assembly, receives an audio-encoded electrical signal, or "audio signal", which causes varying current in the voice coil. By interaction of the voice coil current with the magnetic field of the magnet assembly, sound-producing movement of the former and diaphragm results. The voice coil is constrained to one-dimensional motion, perpendicular to the base plane of the diaphragm, by a flexible support structure called a "spider." The magnet assembly may comprise a magnetically permeable pole piece, a permanent magnet, and a magnetically permeable top plate. The pole piece may feature an annular groove, or "air gap," to permit motion of the voice coil deeper into the magnetic field of the magnet assembly. The diaphragm is supported at its widest perimeter by a flexible surround, or "surround", which, in turn, is supported by a structure called a "basket." The top plate of the magnet assembly and the spider are also connected to the basket. An opening in the diaphragm at its center may be covered with a dust cap, which reduces the amount of dust that may affect voice coil motion in the annular groove. At least a portion of the surround conventionally has a semi-circular or sinusoidal transverse cross-section.

Shallow speakers, as the term is commercially used, are speakers with reduced depths. The depth of a speaker is the maximum dimension of the speaker parallel to the longitudinal axis of motion of the speaker. The advantage of a shallow speaker is that it may be used in mounting environments where thicker speakers may not be suitable. For example, shallow speakers may be used in conjunction with flat screen television sets, automobiles, or audio systems for small apartments. The reduced depth of shallow speakers can come at the cost of reduced excursion for the diaphragm.

The amount of sound produced by a speaker is proportional to the air volume displaced by the diaphragm in its axially oscillatory motion. The volume displacement, in turn, is determined as a function of the area of the plane of the diaphragm at its largest point and by the maximum distance it can travel from a quiescent state, called the speaker's "excursion." The designer must strike a balance between the size of the excursion, enabling more sound if the excursion is larger, and the depth of the speaker. Accordingly, the aim of shallow speaker design is to find ways to maximize volume displacement while maintaining high sound quality and minimizing depth.

Significant problems arise from the use of glue in the manufacture of speakers. The glue joints age faster than other connections. The aging takes the form of strain hardening and stress fracture in the glue joint, resulting in failure of the speaker. Some glue joints are riskier than others. High-risk glue joints are glue joints that connect two rigid members in contact in a moving system, or connect more than two members, whether rigid or flexible.

The cost of manufacture is another important consideration in speaker design. Intricate manufacture means expensive manufacture, quality risks, and reliability risks. Generally, designs having many parts or features will require more intricacy in manufacture than designs having fewer parts. The number of attachments that must be made between the parts is also a contributor to manufacturing cost. Alignment is also part of the manufacturing problem. The more separate pieces that have to be aligned about the longitudinal axis of speaker motion, the more difficult and expensive the manufacturing of the speaker becomes.

There have been attempts by others to accomplish shallow speakers without sacrifice of excursion. Proni (U.S. Pat. Nos. 5,734,132, 6,095,280, and 6,501,844) employs a substantially cylindrical tubular surround, of greater diameter than the magnet assembly, attached between an inner perimeter of an annular spider and a diaphragm. Proni's approach requires intricate manufacture and high-risk glue joints. Proni does not provide vents in the tubular surround itself, but provides an optional ring (which you really need!) between the diaphragm and the tubular surround, which provides vents. Proni also teaches rigid-to-rigid glue joints.

Funahashi (U.S. Pat. Nos. 7,203,333, 7,209,570, and published US Patent applications 20060215871, 20060245615, 20070177757) adopted a principle of operation of reducing the effect of non-linearity in the surround by using an inverted second edge, or surround, for the rear surround, in place of a spider. Funahashi's approach requires intricate manufacture and high-risk glue joints. Funahashi's second edges require more clearance than spiders, and the stiffness is not progressive, as with a spider. Funahashi's use of the inverted surround requires a surround holder between the second edge and the bobbin, or former, to reach across the space that a longer spider would otherwise occupy, and to avoid the magnet assembly. Funahashi's diaphragm and surround holder are rigid and are glued to the rigid bobbin and, in some embodiments, to each other. Funahashi's approach requires a glue joint between the second edge and the rigid surround holder, and limits the damping action to the frequencies affected by the edges. Funahashi uses the rigid inner portion of his surround holder to support the diaphragm in a triangular structure with the bobbin that apparently attempts to compensate for the propensity of second edges to flop about, rather than firmly center the bobbin and voice coil. Funahashi's last US application indicates that the success anticipated for his earlier work did not fully materialize.

Sahyoun (U.S. Pat. Nos. 7,185,735, 7,197,154, 7,225,895 and US Patent published application 20040076309) also adopted a principle of operation of reducing the effect of non-linearity in the surround by using an inverted second edge, or surround, for the rear surround, in place of a spider. Sahyoun's speakers also require intricate manufacture and high-risk glue joints. Sahyoun's outer V-shaped diaphragm flange has two surrounds attached. Sahyoun's second edge also limits the damping action to the frequencies affected by the edges. Sahyoun also teaches a spider glued to an apex of a V-shaped diaphragm optionally with an additional diaphragm overlaying and glued to the V-shaped diaphragm. Yet another embodiment Sahyoun teaches a vertically downward flange of a diaphragm.

Krenmeir (Published U.S. Patent Application 20040165764) also teaches inverted opposed edges for improving linearity as well as a support structure to improve the rigid joint created by the diaphragm and the bead mount between the bobbin and the inner edge. Kreitmeler's speakers also require intricate manufacture and high-risk glue joints, as well as additional power to move the mass of the support structure.

Horigome (Published U.S. Patent Application 20070127768) also teaches inverted opposed edges for improving linearity. Horigome teaches a rigid drive cone glued between the inner edge and the rigid bobbin, with the rigid dust cap and the rigid diaphragm glued to an apex of the rigid drive cone. Horigome forms a gas-tight space with his drive cone, frame, edges and diaphragm to create an air spring. Horigome's speakers require intricate manufacture and very-high-risk glue joints, especially at the juncture of the cone, dust cap, and diaphragm.

Kato (U.S. Pat. No. 6,672,423) teaches an inverted rigid V-shaped cone glued between the rigid bobbin and two parallel spiders with the rigid diaphragm connected to the inverted V-shaped cone at the apex. A cone paper extends from the surround to attach to the forward spider. Kato's speakers require intricate manufacture and high-risk glue joints.

Kobayashi (Published U.S. Patent Application 20050141746) also teaches inverted opposed edges for improving linearity. Kobayashi teaches a rigid drive cone glued between the inner edge and the rigid bobbin, with the rigid dust cap and the rigid diaphragm glued to an apex of the rigid drive cone. Kobayashi forms a gas-tight space with his drive cone, frame, edges, and diaphragm to create an air spring. Kobayashi's speakers require intricate manufacture and very-high-risk glue joints, especially at the juncture of the cone, dust cap, and diaphragm.

Watanabe (Published U.S. Patent Applications 20050276435, 20060018500, and 20060120554) teaches a rigid stepped cylindrical connection member attached to two parallel spiders. Watanabe's rigid connection member is incredibly intricate to manufacture, some versions appearing all but impossible to die press. Watanabe uses rigid metallic terminal members secured in recesses in the sides of the connection member to conduct the audio signal from a tinsel to the voice coil leads. The rigid connection member is glued to the underside of the rigid diaphragm, in the vicinity of the front end of the voice coil bobbin, by a circumferential bead of glue. Watanabe's speakers require extremely intricate manufacture and very-high-risk glue joints, especially at the juncture of the connecting member and diaphragm.

The inventors have recognized a need for improvements to a shallow speaker that is simple to manufacture that suffers no sacrifice of excursion, power, and no loss of sound quality. The inventors have also recognized need for an improved fully integrated new design for an improved shallow speaker. The inventors have also recognized the advantage of reducing the number of glue joints in the design, especially high-risk glue joints. In order to meet those needs, and to solve related problems, the inventors have developed the improvements to the novel shallow speaker of the present invention.

OBJECTS AND FEATURES OF THE INVENTION

A primary object and feature of the present invention is to provide an improved shallow speaker without sacrificing displacement volume. It is a further object and feature of the present invention to provide such a speaker having an improved cone that engages the spider near its outer perimeter. It is a further object of the invention in provide an improved integral diaphragm that has a top portion supporting a lower cylindrical subcone. It is a further object of the invention to provide a cylindrical subcone that engages the spider at its outer perimeter. It is a further object of the invention provide a cylindrical subcone having a radius greater than the radius of the magnet assembly. It is yet another object of this invention to provide a diaphragm with a tinsel embedded in a channel in the subcone. It is yet another object and feature of the present invention to provide a narrow surround with an integral outer flange and forwardly angled radially inner surround flange. It is still yet another object and feature of the present invention to provide such an improved shallow speaker having a diaphragm having a front surface at rest below the plane of the front edge of the surround. A further objective of the present invention is to provide a radially outer circumferential adhesive well proximate the front end of the former, allowing easier centering during assembly by suspending an inner circumferential diaphragm flange in epoxy, which hardens after alignment. A further objective of the present invention is to provide a coil having at least six-layers on the former. A further objective of the present invention is to provide a top plate configured to receive fasteners. A further primary object and feature of the present invention is to provide such a speaker that is efficient, inexpensive, and handy. Other objects and features of this invention will become apparent with reference to the following descriptions.

SUMMARY OF THE INVENTION

In accordance with a preferred embodiment hereof, this invention provides an improved shallow speaker, where the improvement includes a diaphragm including: a top portion having an inner perimeter and an outer perimeter; an outer perimeter portion sloped downwardly extending outward from the top portion outer perimeter; a depressed central portion extending inwardly from the top portion inner perimeter and having an annular glue flange; and an annular cylindrical subcone depending from at least a portion of the outer perimeter portion and sized and positioned to engage an outer perimeter of a spider of the improved shallow speaker when assembled. The improved shallow speaker, where the improvement further includes: a top plate on an annular magnet having a raised outer annular portion including: a top surface; a rounded top outer corner extending downward from the top surface; and an inner spider flange, where the inner spider flange is operable to be adhered to the top surface of the raised outer portion of the top plate. The improved shallow speaker, where: the top plate includes a pattern of threaded screw holes through the top surface; a spider ring including: a flat annular body sized to cover the top surface; an inner downward-depending flange extending from the flat annular body; and a pattern of screw holes alignable to the pattern of threaded screw holes; and the inner spider flange including the pattern of screw holes alignable to the pattern of threaded screw holes; where the inner spider flange is further secured to the top surface of the raised outer portion of the top plate with the spider ring secured over the inner spider flange with screws through the patterns of screw holes and into the pattern of threaded screw holes. The improved shallow speaker, the improvement including the diaphragm including a channel for securely routing a tinsel. The improved shallow speaker, where the improvement includes the diaphragm including: a first perforation in the annular cylindrical subcone; and a second perforation in the depressed central portion; where the first perforation and the second perforation are sized, shaped, and arranged to permit a tinsel to be threaded through the first perforation and the second perforation. The improved shallow speaker, where the improvement includes a tinsel, where the spider includes a spider tinsel opening sized, shaped, and arranged to permit the tinsel to be threaded through the spider tinsel opening. The improved shallow speaker, where the improvement includes the outer perimeter of the diaphragm top portion having a cornered shape. The improved shallow speaker, further including: a plurality of support flanges connecting the annular cylindrical subcone to the diaphragm top portion; the depressed central portion comprising an outer perimeter having a cornered shape; the inner annular glue flange having an upwardly extending outer annular wall with a second plurality of support flanges extending radially outward from the upwardly extending outer annular wall across at least a portion of the depressed central portion. The improved shallow speaker, where the improvement includes: a spider including an outer annular spider flange coupled to a vertical annular spider flange; and an outer roll of the spider, forming a channel with the outer annular spider flange coupled to the vertical annular spider flange, where the channel is operable to receive a bottom edge of the annular cylindrical subcone and to adhere the bottom edge of the annular cylindrical subcone to the spider.

An improved shallow speaker, where the improvement includes a diaphragm including: a top portion having an inner perimeter and an outer perimeter; an outer perimeter portion sloped downwardly extending outward from the top portion outer perimeter; a depressed central portion extending inwardly from the top portion inner perimeter and having an inner annular glue flange; an annular cylindrical subcone depending from the outer perimeter portion and sized and positioned to engage an outer perimeter of a spider of the improved shallow speaker when assembled; and a channel, that is formed one of along and into a surface of the diaphragm, for securely routing a tinsel. The improved shallow speaker, where the improvement further includes: a top plate on an annular magnet, the top plate having a raised outer annular portion including: a top surface; a rounded top outer corner extending downward from the top surface; and an inner spider flange, where the inner spider flange is operable to be adhered to the top surface of the raised outer portion of the top plate. The improved shallow speaker, including a pattern of threaded screw holes in the top plate through the top surface; a spider ring including flat annular body sized to cover the top surface; an inner downward-depending flange extending from the flat annular body; and a pattern of screw holes alignable to the pattern of threaded screw holes; and the inner spider flange also including the pattern of screw holes alignable to the pattern of threaded screw holes; where the inner spider flange is further secured to the top surface of the raised outer portion of the top plate with the spider ring secured over the inner spider flange with screws through the patterns of screw holes and into the pattern of threaded screw holes. The improved shallow speaker, where the improvement includes the diaphragm including a first perforation in the annular cylindrical subcone, sized, shaped, and arranged to permit the tinsel to be threaded through the first perforation. The improved shallow speaker, where the improvement includes the diaphragm including a second perforation in the depressed central portion, sized, shaped, and arranged to permit the tinsel to be threaded through the second perforation. The improved shallow speaker, where the improvement includes the outer perimeter of the diaphragm top portion having a cornered shape. The improved shallow speaker, further including: a first plurality of support flanges connecting the annular cylindrical subcone to the diaphragm top portion; the depressed central portion including an outer perimeter further including a cornered shape; the inner annular glue flange having an upwardly extending annular wall with a second plurality of flanges extending radially outward from the upwardly extending annular wall across at least a portion of the depressed central portion. The improved shallow speaker, where the improvement includes: a spider including an outer annular spider flange coupled to a vertical annular flange; and an outer roll of the spider forming a channel with the outer annular spider flange coupled to the vertical annular flange, where the channel is for receiving a bottom edge of the annular cylindrical subcone and adhering to the bottom edge of the annular cylindrical subcone. An improved shallow speaker, where the improvement includes: a diaphragm including: a top portion having an inner perimeter and an outer perimeter; an outer perimeter portion sloped downwardly extending outward from the top portion outer perimeter; a depressed central portion extending inwardly from the top portion inner perimeter and having an inner annular glue flange; and an annular cylindrical subcone depending from the outer perimeter portion and sized and positioned to engage an outer perimeter of a spider of the improved shallow speaker when assembled; a channel along a surface of the diaphragm for securely routing a tinsel; a first perforation in the annular cylindrical subcone, sized, shaped, and arranged to permit the tinsel to be threaded through the first perforation; and a second perforation in the depressed central portion, sized, shaped, and arranged to permit the tinsel to be threaded through the second perforation; a top plate on an annular magnet having a raised outer annular portion including: a top surface; a rounded top outer corner extending downwardly from the top surface; a spider including an inner annular spider flange adhered to the top surface of the raised outer annular portion of the top plate. The spider including an outer annular spider flange coupled to a vertical annular flange; and an outer roll of the spider, forming a channel with the outer annular spider flange extending to the vertical annular flange for receiving and adhering a bottom edge of the annular cylindrical subcone. The improved shallow speaker, where the improvement includes: the outer perimeter of the diaphragm top portion including a cornered shape; a plurality of support flanges connecting the annular cylindrical subcone to the outer perimeter portion of the diaphragm having a cornered shape; the depressed central portion having a cornered shape; the inner annular glue flange having an upwardly extending annular wall; and a second plurality of flanges extending radially outward from the upwardly extending annular wall aver at least a portion of the depressed central portion. The improved shallow speaker of claim 19, including: a pattern of threaded screw holes in the top plate and through the top surface; a spider ring including: a flat annular body sized to cover the top surface; an inner downward-depending flange extending from the flat annular body; and a pattern of screw holes alignable to the pattern of threaded screw holes; and the inner spider flange further including the pattern of screw holes alignable to the pattern of threaded screw holes; where the inner spider flange is further secured to the top surface of the raised outer portion of the top plate with the spider ring secured over the inner spider flange with screws through the patterns of screw holes and into the pattern of threaded screw holes.

An improved shallow speaker, where the improvement includes: a diaphragm including: a top portion having an inner perimeter and an outer perimeter; an outer perimeter portion sloped downwardly extending outward from the top portion outer perimeter; a depressed central portion extending inwardly from the top portion inner perimeter and having an inner annular glue flange; and an annular cylindrical subcone depending from the outer perimeter portion and sized and positioned to engage an outer perimeter of a spider of the improved shallow speaker when assembled; a channel along a surface of the diaphragm for securely routing a tinsel; a first perforation in the annular cylindrical subcone, sized, shaped, and arranged to permit the tinsel to be threaded through the first perforation; and a second perforation in the depressed central annular region, sized, shaped, and arranged to permit the tinsel to be threaded through the second perforation; a top plate having a raised outer annular portion including: a top surface; a rounded top outer corner extending downwardly from the top surface; a spider including an inner annular spider flange adhered to the top surface of the raised outer annular portion of the top plate. The spider including an outer annular spider flange coupled to a vertical annular flange; and an outer roll of the spider, forming a channel with the outer annular spider flange extending to the vertical annular flange for receiving and adhering a bottom edge of the annular cylindrical subcone. The improved shallow speaker, where the improvement includes: the diaphragm top portion having a cornered shape; a plurality of support flanges connecting the annular cylindrical subcone to the diaphragm having a cornered shape; the depressed central portion having a cornered shape; the inner annular glue flange having an upwardly extending annular wall; and a second plurality of flanges extending radially outward from the upwardly extending annular wall over at least a portion of the depressed central portion.

BRIEF DESCRIPTION OF THE DRAWINGS

The above and other objects and advantages of the present invention will become more apparent from the following description taken in conjunction with the following drawings in which.

DETAILED DESCRIPTION OF THE BEST MODES AND PREFERRED EMBODIMENTS OF THE INVENTION

As used and defined herein, "top" and "front" means proximal to the primary sound-emitting end of the speaker and "rear" or "bottom" means distal the primary sound-emitting end of the speaker. As used and defined herein, "downward" means towards the bottom, as previously defined. As used and defined herein, "upward" means towards the bottom, as previously defined. As used and defined herein, "integral", when applied to a structure, means a structure made as a single entire piece in one operation, optionally with portions later given various treatments and modifications, but not a structure assembled from separate parts. As used and defined herein, "inward" means radially inward towards the axis of radial symmetry of the pole piece and magnet, whether or not within the pole piece or magnet. As used and defined herein, "outward" means radially outward towards the axis of radial symmetry of the pole piece and magnet, whether or not within the pole piece or magnet.

Figure 1:
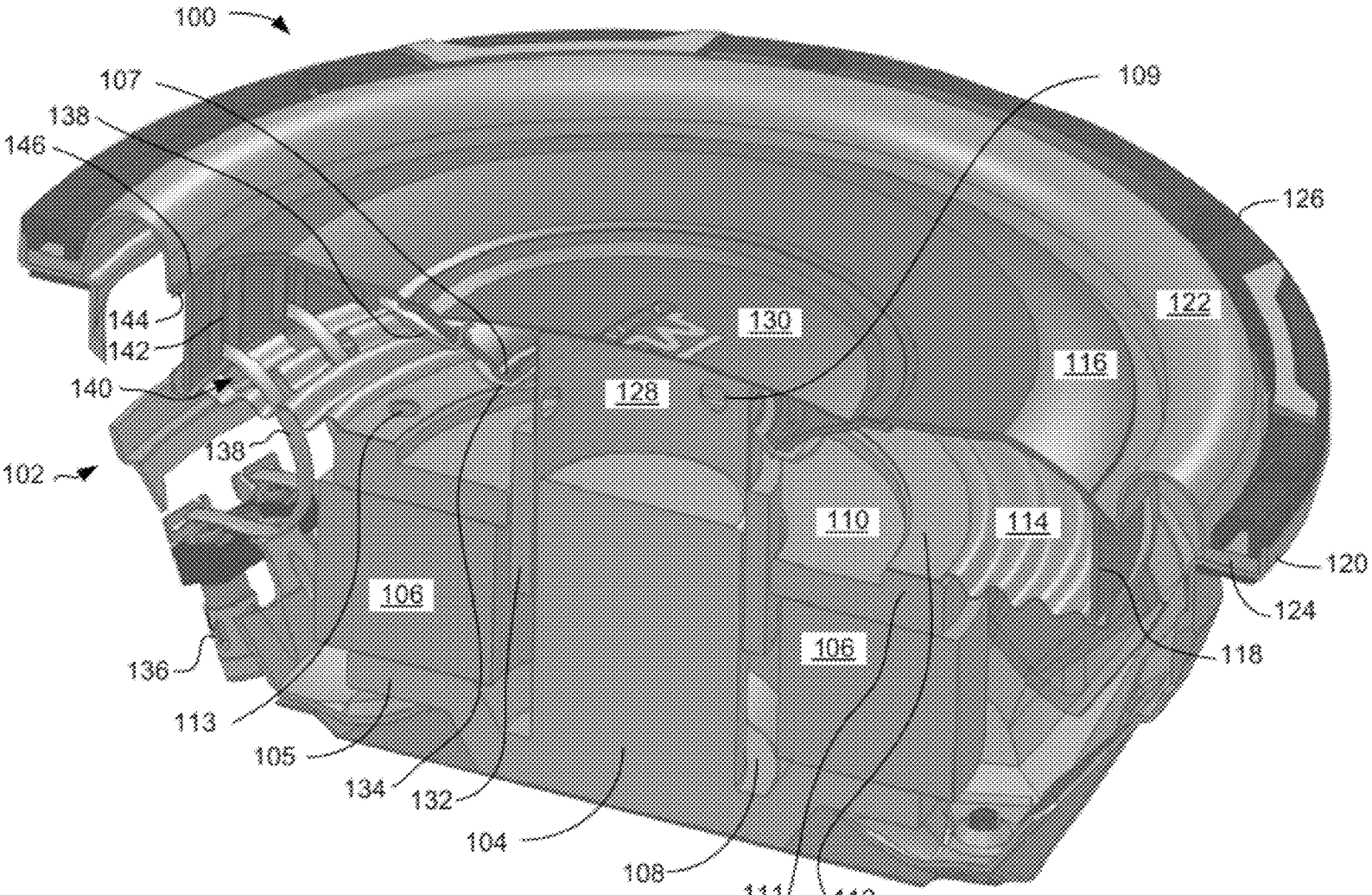
FIG. 1 is a top-side perspective cross-sectional view illustrating a first improved shallow speaker, according to a preferred embodiment of the present invention.

FIG. 1 is a top-side perspective cross-sectional view illustrating a first exemplary improved shallow speaker 100, according to a preferred embodiment of the present invention. The basket 102 supports pole piece 104 having outer annular pole flange 105 that supports annular magnet 106. Annular magnet 106 is larger than its predecessor (U.S. Pat. No. 7,433,485 B1) in its inside and outside diameters to create a larger gap 108 to accommodate the improved six-layer coil 132 while still providing a strong magnetic field in air gap 108. Annular magnet 106 extends radially outward beyond the outer annular pole flange 105 farther than with its predecessor (U.S. Pat. No. 7,433,485 B1). Top plate 110 has an inner annular portion of a first thickness and an outer annular portion 111 of a second, greater, thickness that is adequate to include screw holes (not shown in this view) that are aligned to screw holes 113 in aluminum spider ring 112 that assists in clamping an inner annular flange of spider 114 to a top surface 306 (see FIG. 3) of the outer annular portion 111 of top plate 110.

Ventilated former 128 supports the six-layer coil 132 and is aligned to pole piece 104 so as to allow free vertical movement in the air gap 108. Ventilated former 128 supports an outer annular glue well 134 above former ventilation ports 109, which glue well 134 receives an inner annular flange 107 of diaphragm 116. Thus, the former 128 is suspended from the diaphragm 116. The diaphragm 116 is supported by resilient surround 122 that couples to a sloped outer perimeter portion 144 of the diaphragm 116 by inner surround flange 146. Outer surround flange, or gasket, 124 is supported by the rim 120 portion of basket 102. Trim gasket 126 is secured to outer surround gasket 124 and to rim 120.

Diaphragm 116 includes cylindrical subcone 118 which depends vertically from the bottom of diaphragm 116 to couple to the spider 114 proximate an outer perimeter of spider 114. Spider 114 has openings 140 (one of two labeled) to enable routing of tinsel 138 (one of two labeled) to channels 142 (one of two labeled) in cylindrical subcone 118. Tinsel 138 conducts the audio signal from terminals 136 to six-layer coil 132. Channels 142 extend up the inside surface of cylindrical subcone 118 and then along the underside of a portion the top portion of diaphragm 116. Channels 142 may be made by parallel raised portions, as shown. In an alternate embodiment, the channels may be linear depressed regions in the inner surface of cylindrical subcone 118. Tinsel 138 penetrates the top portion of diaphragm 116 proximate the former 128 and sufficiently within the area covered by dust cap 130 to avoid interference with dust cap 130. Tinsel 138 connects (not shown) to six-layer coil 132. In an alternate embodiment, the coil 132 may have more than six layers. The extent to which channel 142 extends underneath the top portion of diaphragm 116 may vary among various alternate embodiments. In a preferred embodiment, the tinsel 138 may penetrate cylindrical subcone 118 proximate the bottom, be channeled along the outer surface of cylindrical subcone 118, and then penetrate the cylindrical subcone 118 again, proximate the top edge thereof, to the interior surface thereof, and then be routed along the bottom surface of the diaphragm 116, at least partially in channel 142.

Figure 2:
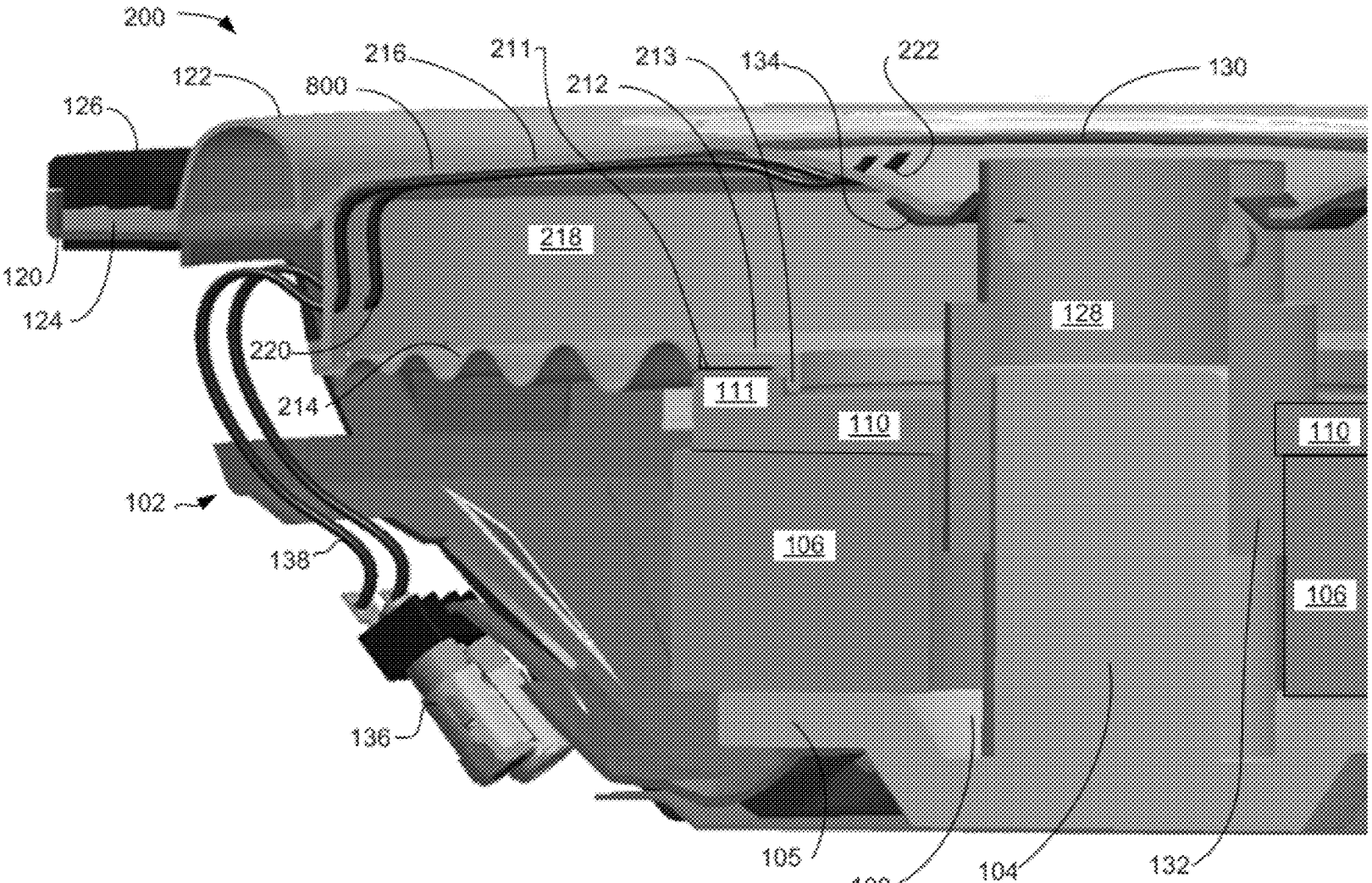
FIG. 2 is a side elevation cross-sectional view illustrating a second exemplary improved shallow speaker, according to a preferred embodiment of the present invention.

FIG. 2 is a side elevation partial cross-sectional view illustrating a second exemplary improved shallow speaker 200, according to a preferred embodiment of the present invention. Cylindrical subcone 218 has perforations 220 (one of two labeled) for routing the tinsel 138 toward the six-layer coil 132 by threading the tinsel through perforations 220 without penetrating the spider 214. Tinsel 138 is routed from terminals 136 through perforations 220 in cylindrical subcone 218, upward against the inner surface of cylindrical subcone 218, and then along the underside of the top portion 216 of diaphragm 800 (see FIGS. 8A and 8B) until routed through perforations 222 (one of two labeled) and then connected to the leads (not shown) of the six-layered coil 132. Perforations 220 and 222 are preferably molded into the diaphragm 116 but, in various alternate embodiments, may be drilled or punched.

Aluminum spider ring 212 assists in clamping an inner annular flange 211 of spider 214 to a top surface 306 (see FIG. 3) of the outer annular portion 111 of top plate 110. Aluminum spider ring 212 has an inner depending annular flange 213 for assisting with alignment and resisting radially outward forces exerted by the spider 214 during operation. Spider ring 212 is preferably aluminum but, in various alternate embodiments, may be one of various rigid nonmagnetic material having similar strength and vibration resistance properties.

Figure 3:
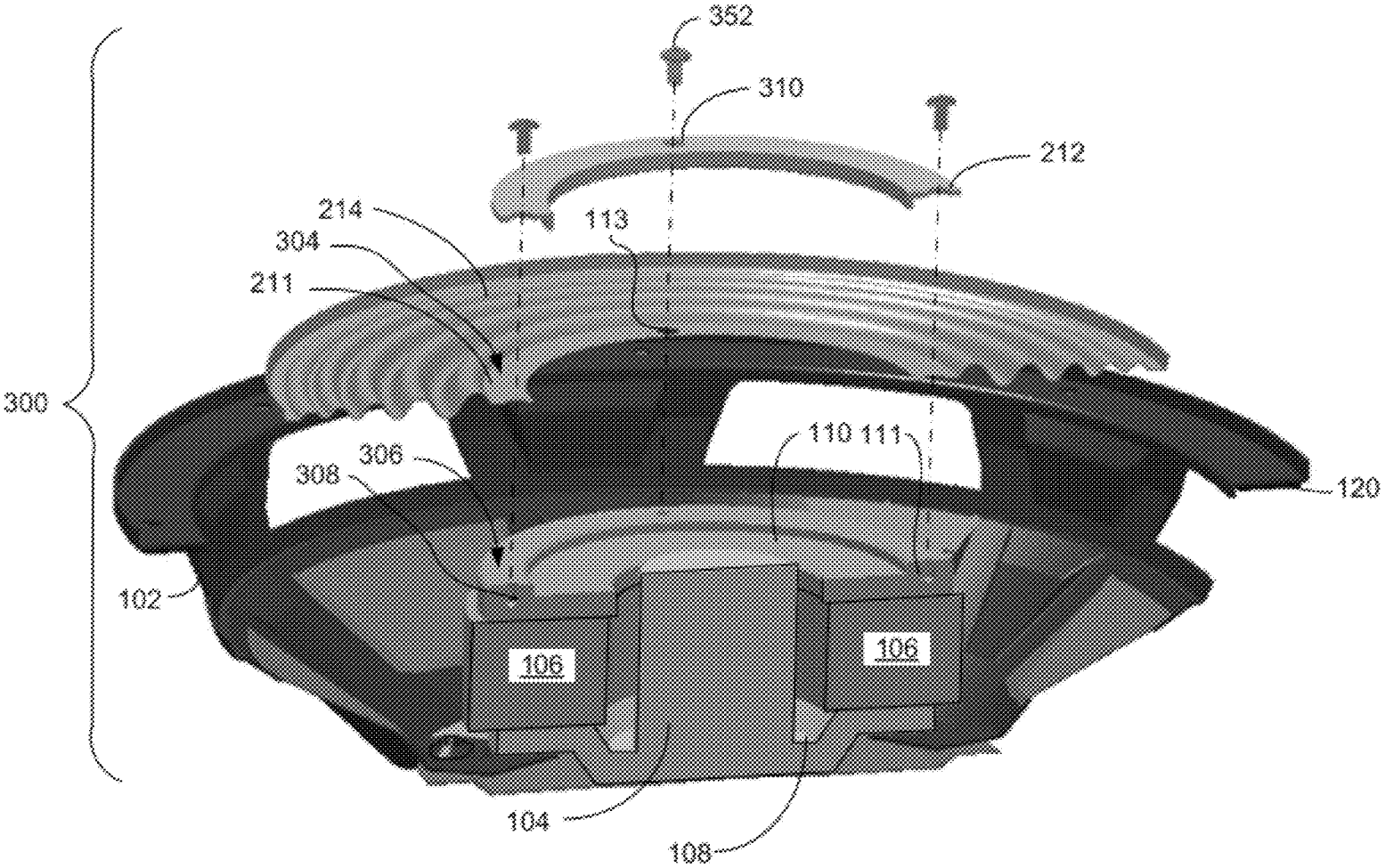
FIG. 3 is a cross-sectional, cut-away, exploded, top-side perspective view illustrating the exemplary second embodiment of the novel improved speaker at an exemplary step in the assembly, according to a preferred embodiment of the present invention as shown in FIG. 2.

FIG. 3 is a cross-sectional, cut-away, exploded, top-side perspective view illustrating the exemplary second embodiment of the novel improved speaker 200 at an exemplary step 300 in the assembly, according to a preferred embodiment of the present invention as shown in FIG. 2. Basket 102 has received pole piece 104, magnet 106, and top plate 110 in the manner known in the art. Outer annular portion 111 of top plate 110 has screw holes 308 (one of three labeled) for receiving zinc screws 252 (one of three labeled) through aligned spider ring holes 310 (one of three labeled) of spider ring 212 and through aligned spider inner flange holes 113 (one of three labeled) in spider inner annular flange 211. Prior to assembly and tightening of screws 352, a bead of glue is applied along the arcuate length of the top surface 306 of outer annular portion 111 of top plate 110, and along the arcuate length of the top surface 304 of spider inner annular flange 211. Thus, inner annular spider flange 211 is glued into place on the flange top surface 304 and flange bottom surface (against 306) and the glue joints are further reinforced by the clamping action of spider ring 212 and screws 352. Screws 352 are wetted with glue, thread locking compound, or the like. Note that the outer top corner of outer annular portion 111 of top plate 110 is rounded to avoid a sharp edge against the spider 214 during operation.

Figure 4:
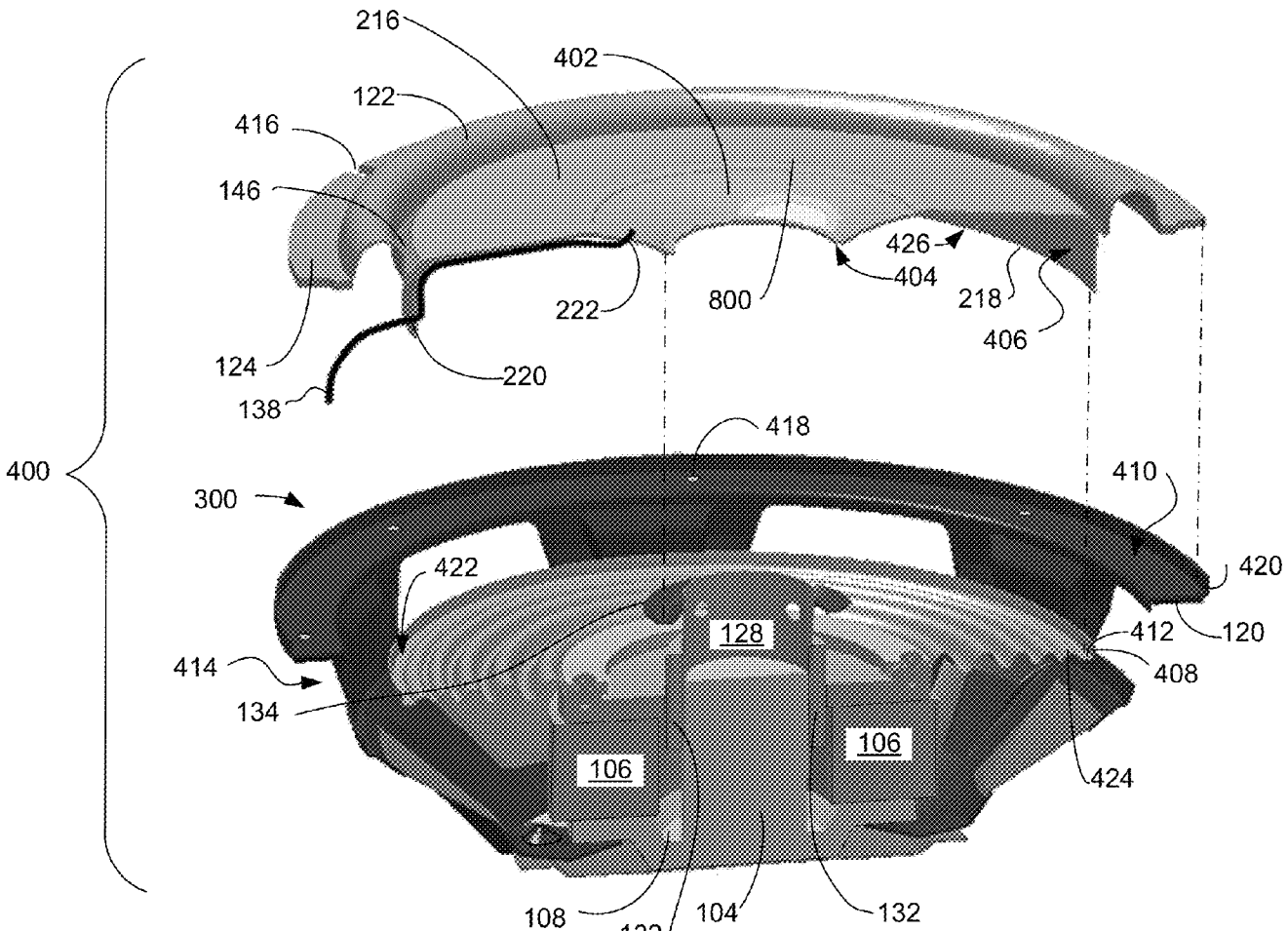
FIG. 4 is a cross-sectional, cut-away, exploded, top-side perspective view illustrating the exemplary second embodiment of the novel improved speaker at an exemplary subsequent step in the assembly, according to a preferred embodiment of the present invention as shown in FIG. 2.

FIG. 4 is a cross-sectional, cut-away, exploded, top-front perspective view illustrating the exemplary second embodiment of the novel improved speaker 200 at an exemplary subsequent step 400 in the assembly, according to a preferred embodiment of the present invention as shown in FIG. 2. The speaker 200 in assembly illustrates the parts of FIG. 3 assembled 300 plus installation of the former 128 with attached six-layer coil 132 and outer annular glue well 134. Former 128 is held in place by a jig (not shown) during assembly. Former 128 is ventilated below the glue well 134 to avoid over-pressurizing the air above the pole piece 104 during oscillatory operation.

Diaphragm 800 is illustrated as aligned for assembly and includes depending cylindrical subcone 218; top portion 216 depressed central annular region 402, which will be covered by the dust cap 130 in a subsequent step; and annular glue flange 404. Surround 122 has been attached (preferably by adhesive) via inner surround flange 146 to a downwardly inclined radially outer edge 144 of diaphragm 216. Tinsel 138 has been routed through perforation 220 in cylindrical subcone 218, upward along the inner surface 406 of cylindrical subcone 218, and along the underside of a portion of the radially outer edge 144, along the underside of the top portion of diaphragm 216, and through perforation 222 in depressed central annular region 402. In assembly, the outer end of tinsel 138 is routed through basket window 414 (one of four labeled).

Outer surround gasket 124 aligns with rim 120 using key 416. Outer surround gasket 124 has a flat upper surface 410, a vertical annular outer flange 420, and bolt holes 418 (one of four in this view labeled). In assembly, a bead of glue is applied along, the top surface 410 of rim 120 for receiving and adhering outer surround gasket 124. Key 416 aligns bolt holes (not shown) in outer surround gasket 124 with bolt holes 418.

Another bead of glue is applied within the glue well 134 for receiving and adhering glue flange 404. After such attachment is initially made, the glue well 134 is filled with glue on top of glue flange 404.

Spider 214 preferably has a radial cross section of a damped sinusoid, with the roll amplitude deceasing in the radially outward direction. In various alternate embodiments, other spider cross-sections may be used. Spider 214 also has an inner spider flange 211 and an outer annular spider flange 412 coupled to a vertical annular flange 408 which, with outer roll 424, creates a trough at the outer perimeter of spider 214. Yet another glue bead is applied to the top surface 422 of outer annular spider flange 412 and the bottom edge 426 of cylindrical subcone 218 is received in and adhered to trough 424, 412, and 408.

After the glue has dried in the glue well 134, the centering jig (not shown) is removed.

Figure 5:
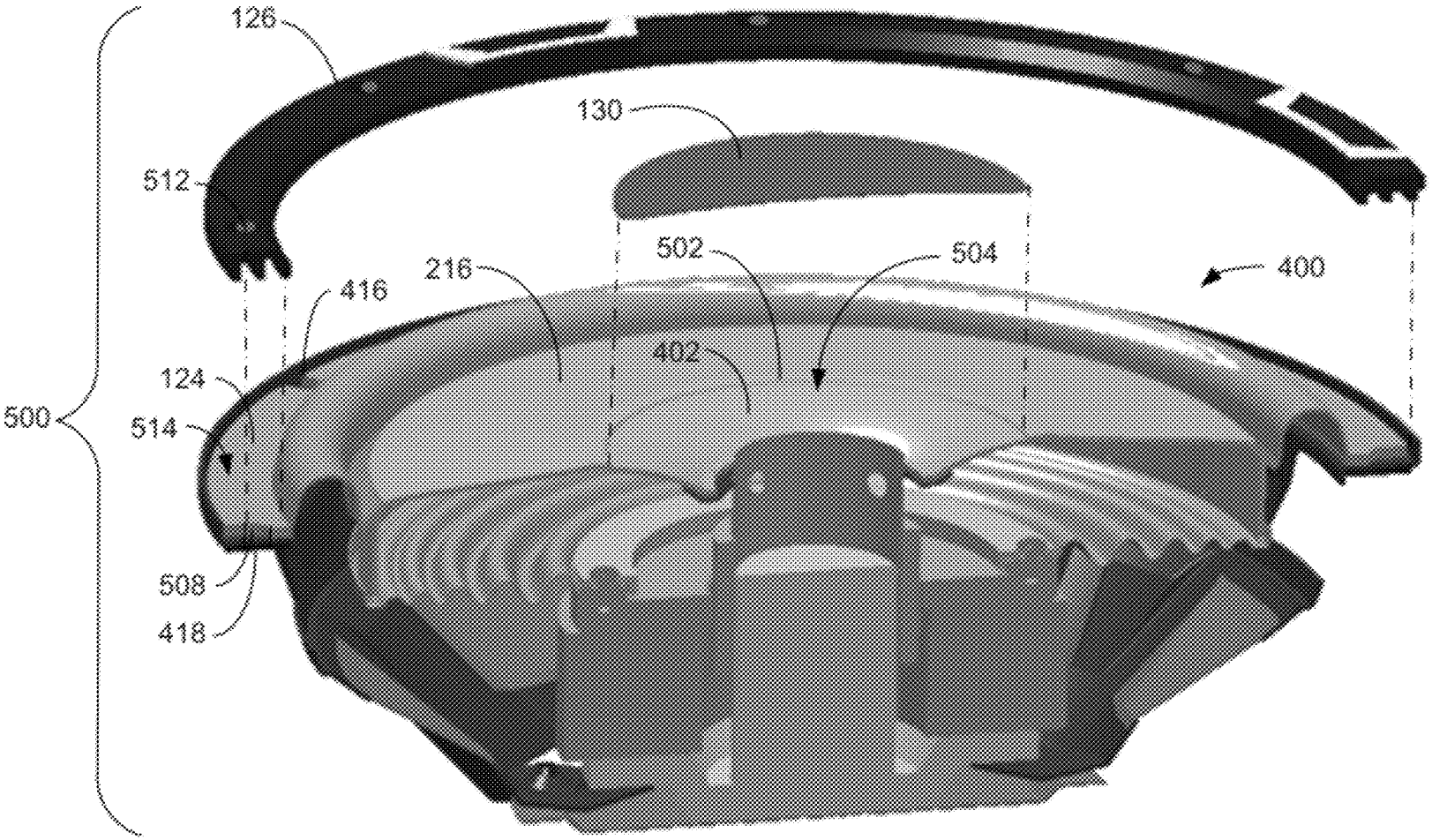
FIG. 5 is a cross-sectional, cut-away, exploded, top-side perspective view illustrating the exemplary second embodiment of the novel improved speaker at an exemplary further subsequent step in the assembly, according to a preferred embodiment of the present invention as shown in FIG. 2.

FIG. 5 is a cross-sectional, cut-away, exploded, top-front perspective view illustrating the exemplary second embodiment of the novel improved speaker 200 at an exemplary further subsequent step 500 in the assembly, according to a preferred embodiment of the present invention as shown in FIG. 2. Trim gasket 126 is aligned to key 416 to align trim gasket bolt holes 512 (one of four in this view labeled) to surround gasket bolt holes 508 (one of two in this view labeled) in outer surround gasket 124, which are aligned with rim bolt holes 418. A bead of glue is applied along the arcuate length of the top surface 514 of outer surround flange 124 to receive and adhere trim gasket 126. Trim gasket bolt holes 512, surround gasket bolt holes 508 and rim bolt holes 418 are aligned to provide for fasteners, such as bolts, used for securing the speaker 100 to a panel or cabinet. Trim gasket 126 is preferably made of plastic. In various alternate embodiments, other non-magnetic materials may be used.

Annular ridge 502 on diaphragm 800 defines a boundary between the top portion 216 of diaphragm 800 and depressed central annular region 402. A bead of glue is applied proximate ridge 502 on surface 504 of depressed central annular region 402 to receive and adhere the outer perimeter of circular domed dust cap 130. Dust cap 130 may support various designs or logos, as desired. Dust cap 130 is preferably made of plastic. In an alternate embodiment, a non-plastic, non-magnetic, lightweight rigid material may be used for dust cap 130.

Figure 6:
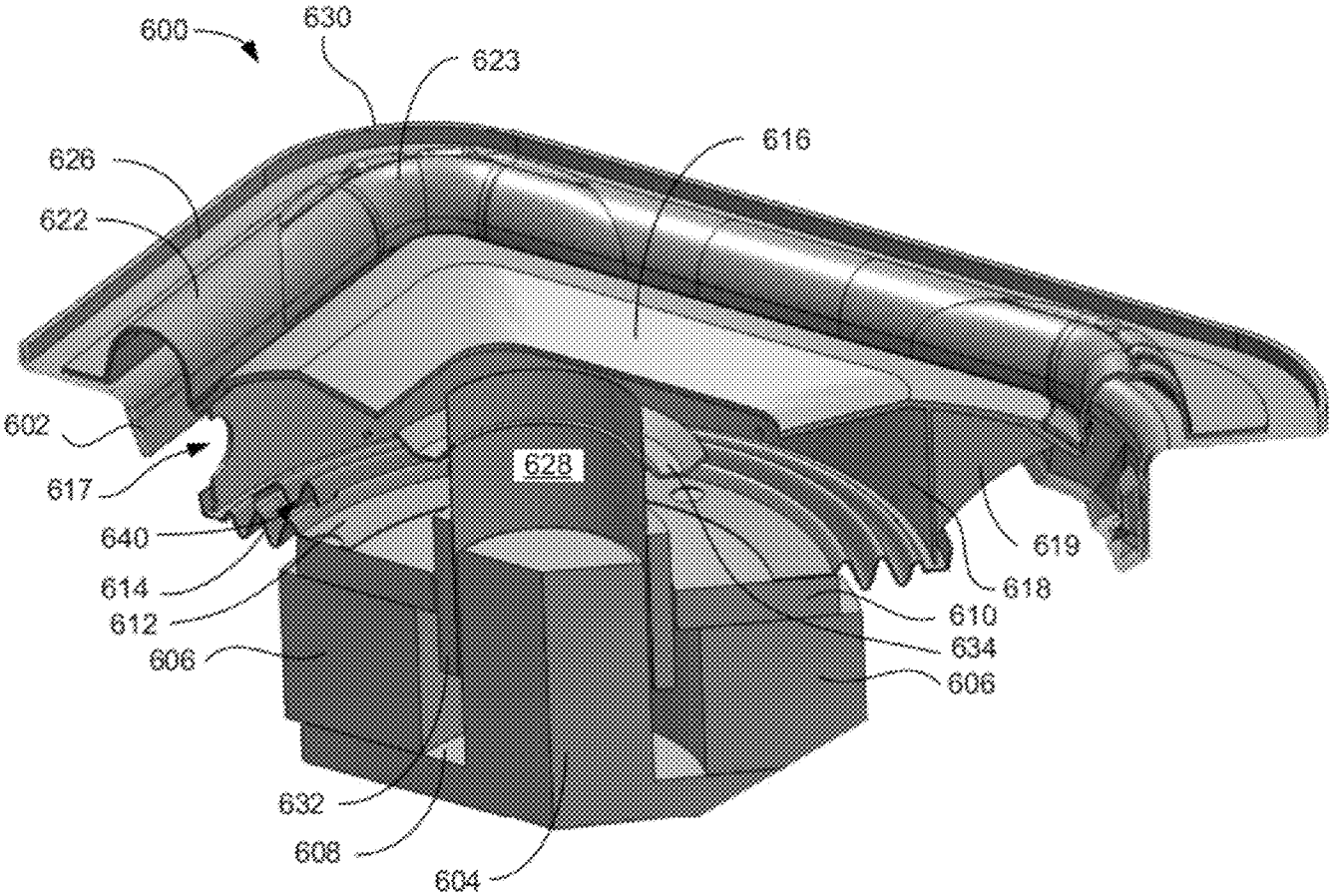
FIG. 6 is a sectional cut-away top-side perspective view illustrating a third exemplary improved speaker, according to a third preferred embodiment of the present invention.

FIG. 6 is a sectional cut-away top-side perspective view illustrating a third exemplary improved speaker 601), according to a third preferred embodiment of the present invention. Speaker 600 is a cornered 630 speaker 600, illustrated as having a square basket 602, square rim 626, and square surround 622, 623 like that in U.S. Pat. No. 7,275,620, to at least one common inventor of the present inventor. The square diaphragm 616 has an annular cylindrical subcone 618 similar to cylindrical subcone 218 that engages the circular spider 614 in a similar manner as with speaker 200. Pole piece 604 supports annular magnet 606 which supports top plate 610. Inner spider flange 612 may be fastened to top plate 610 with adhesives and screws. In a preferred embodiment, pole piece 610 is replaced by pole piece 110 and inner spider flange 612 is secured in a manner similar to inner spider flange 211. Spider 514 may have openings 640 for routing tinsel 138 (not shown in this view), in a preferred embodiment, tinsel 138 may be routed through opening 617 in cylindrical subcone 618 and along the underside of square diaphragm 616. A plurality of support flanges 619 extend from the outer surface of the cylindrical subcone 618 to the underside of the square diaphragm 616 to distribute forces evenly between the circular driver and the square diaphragm 616.

Former 628 is ventilated (not shown) and supports six-layer coil 632 in gap 608 and supports outer annular glue well 634.

Figure 7:
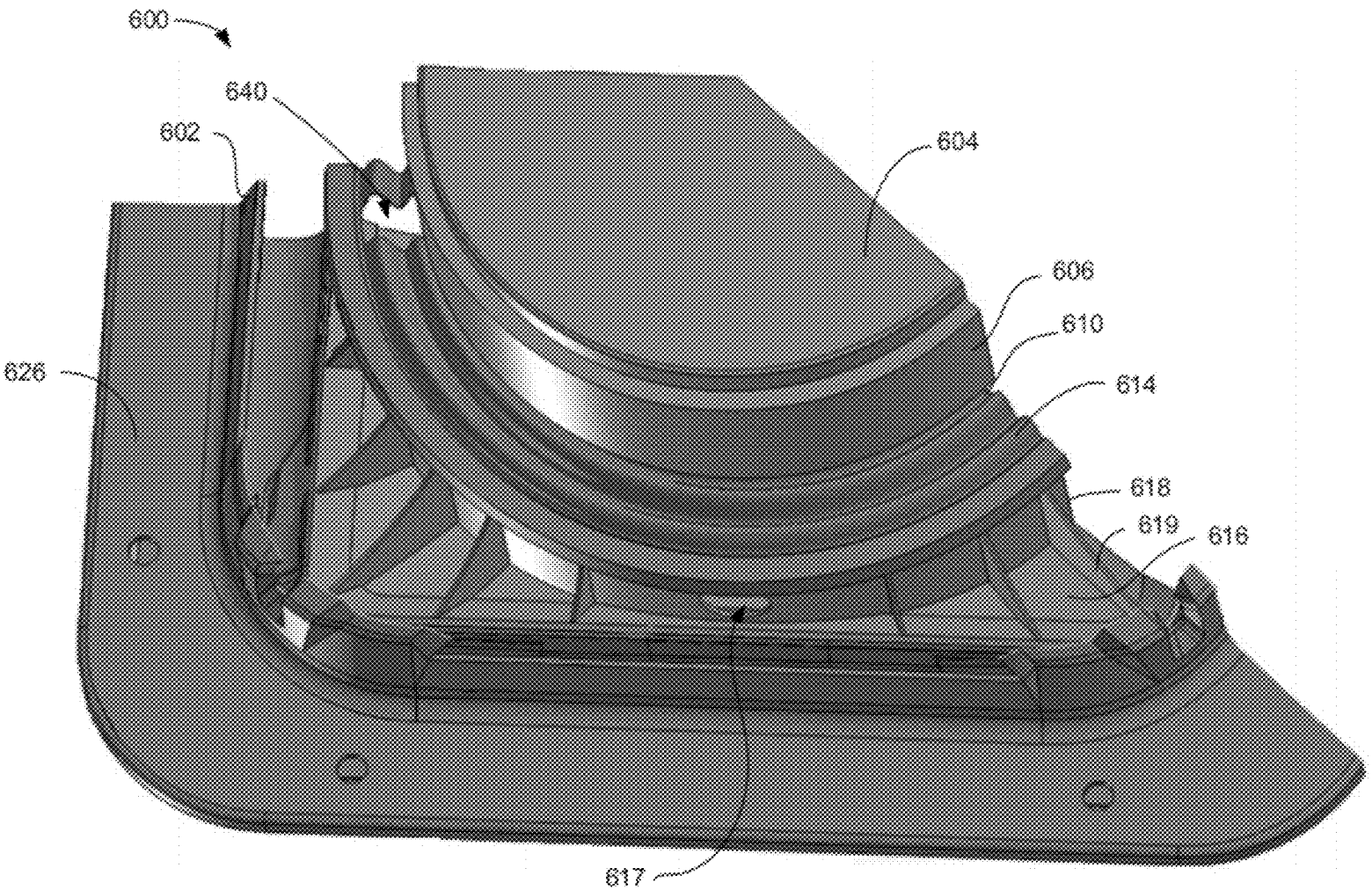
FIG. 7 is a sectional cut-away bottom-side perspective view of an exemplary improved speaker, according to the preferred embodiment of the present invention as shown in FIG. 6.

FIG. 7 is a sectional cut-away bottom-side perspective view of an exemplary improved speaker 600, according to the preferred embodiment of the present invention as shown in FIG. 6. FIG. 7 more clearly illustrates the plurality of support flanges 619 (one of eight in this view labeled) that extends between the cylindrical subcone 618 and the square diaphragm 616.

Figure 8A:
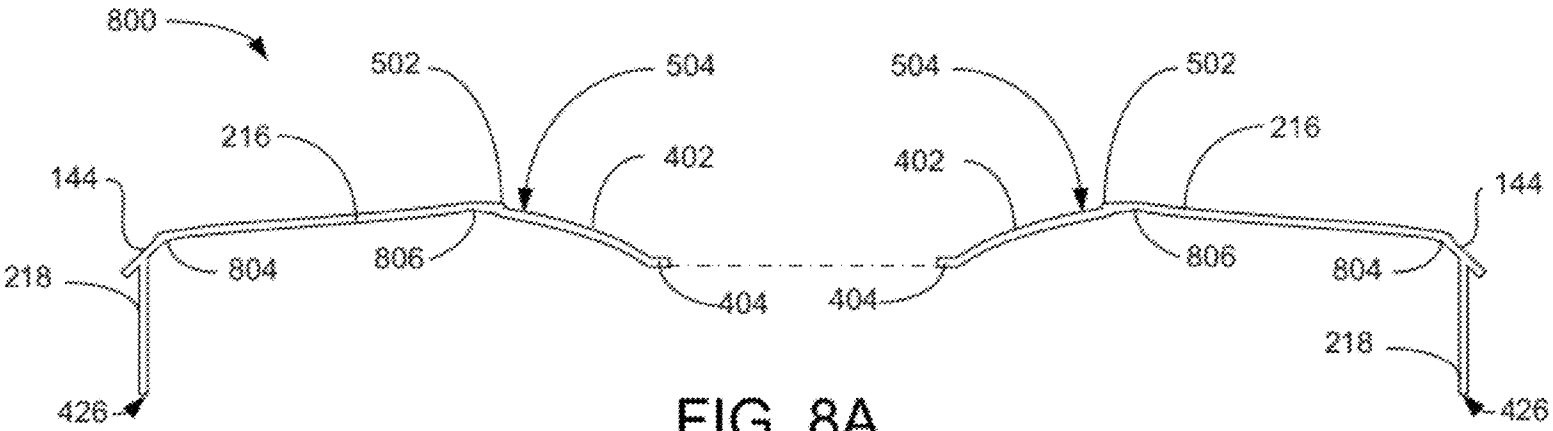
FIG. 8A is a cross-sectional view illustrating an exemplary embodiment of a diaphragm for an exemplary novel shallow speaker, according to a preferred embodiment of the present invention as shown in FIG. 2.

FIG. 8A is a cross-sectional view illustrating an exemplary embodiment of a diaphragm 800 for an exemplary novel improved shallow speaker 200, according to a preferred embodiment of the present invention as shown in FIG. 2. Diaphragm 800 is preferably molded of ABS plastic and may be a colored plastic or may be painted. In various other embodiments, materials other than plastic may be used, but should be light weight and substantially rigid. The top portion 216 is annular and of uniform thickness and has a slight downward slope in the radially outward direction. The outer edge 804 of top portion 216 extends into a more steeply downward sloping outer perimeter portion 144 of the diaphragm 800 that receives the inner surround flange 146. Depending from the downward sloping outer perimeter portion 144 of the diaphragm 800 is the cylindrical subcone 218 which engages, at its bottom edge 426, the outer perimeter of spider 214. The inner edge 806 of top portion 216 extends into a ridge 502 and then into a depressed central annular region 402 which terminates in an annular glue flange 404.

Figure 8B:
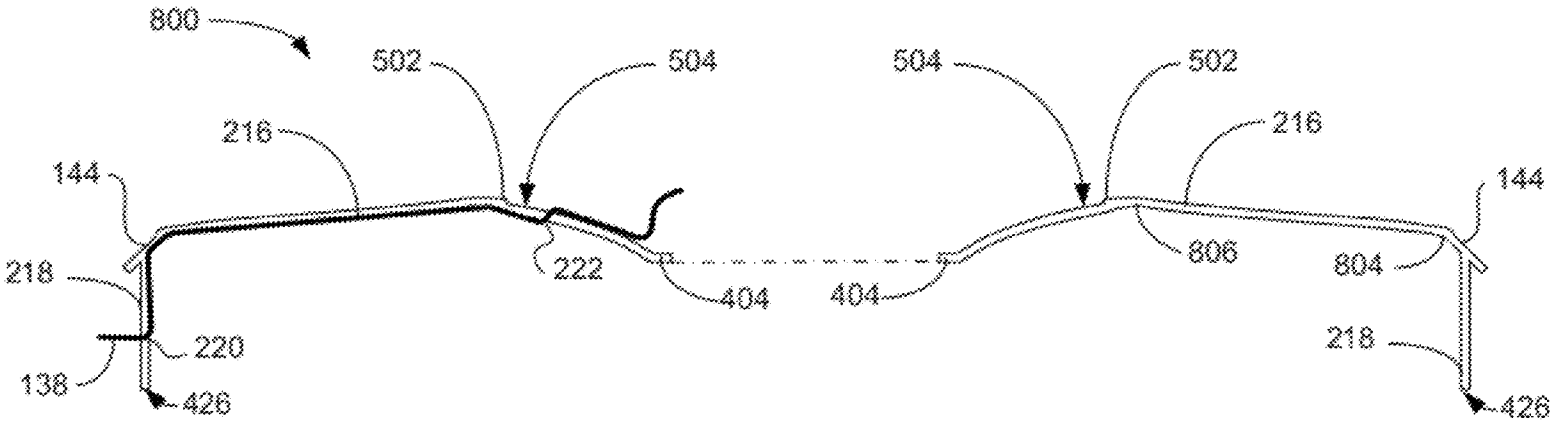
FIG. 8B is a cross-sectional view illustrating another exemplary embodiment of a diaphragm for an exemplary novel shallow speaker, according to a preferred embodiment of the present invention.

FIG. 8B is a cross-sectional view illustrating another exemplary embodiment of a diaphragm 800 for an exemplary novel shallow speaker 200, according to a preferred embodiment of the present invention. Tinsel 138 is routed from the speaker audio signal terminals 136 through a perforation 220 in cylindrical subcone 218, up the inner surface of cylindrical subcone 218, along an underside portion of downward sloping outer perimeter portion 144 of the diaphragm 800, along the underside of top portion 216, past edge 806, and along the underside of depressed central annular region 402 to and through perforations 222 were connection is made with the six-layer coil 132 leads (not shown). Preferably, tinsel 138 is arranged at least partially in a channel 142 along the inside surface of cylindrical subcone 218 and the undersides of downward sloping outer perimeter portion 144 of the diaphragm 800, the underside of top portion 216, edge 806, and the underside of depressed central annular region 402 to perforations 222.

Figure 9:
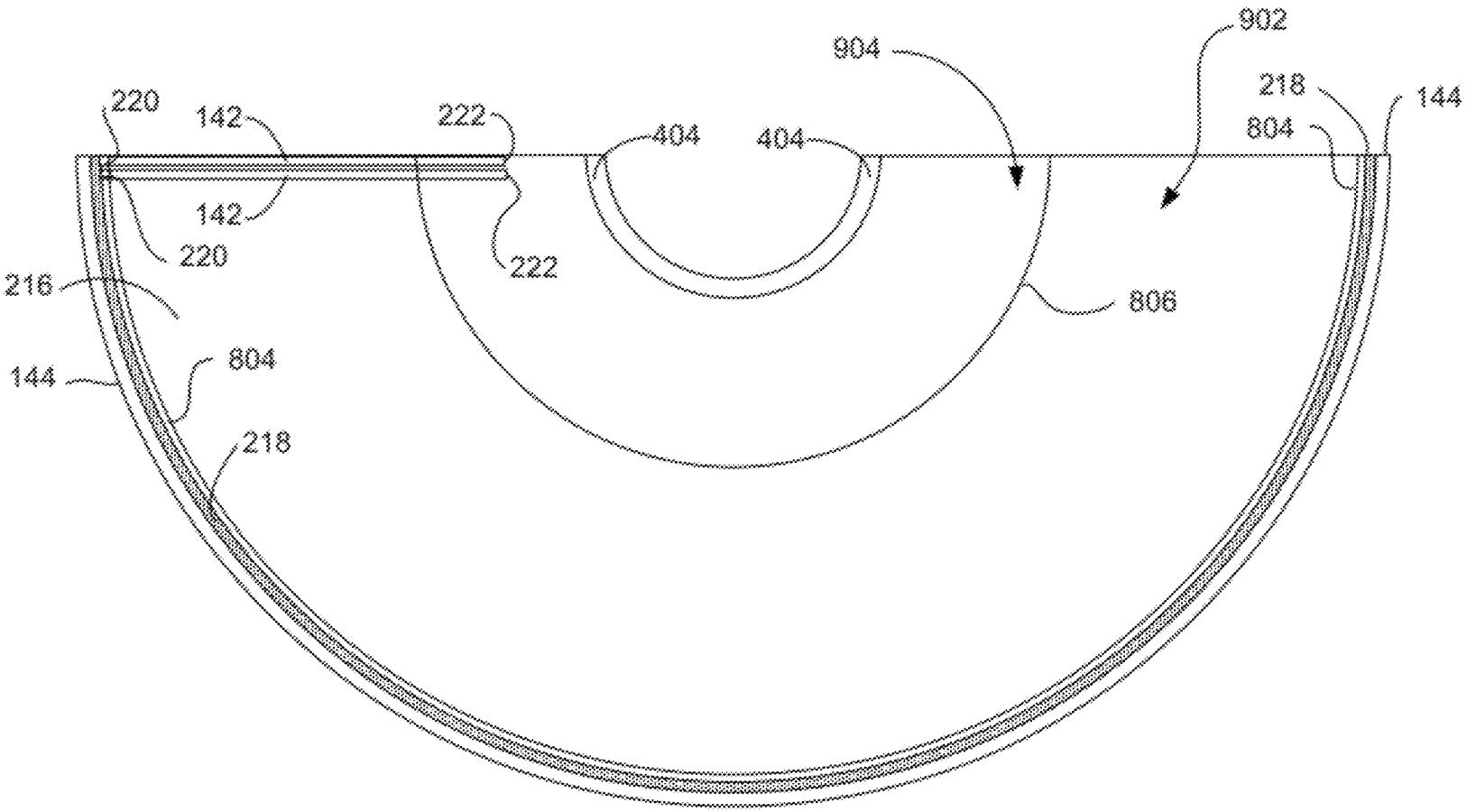
FIG. 9 is a partial bottom plan view illustrating an exemplary embodiment of an exemplary diaphragm for an exemplary novel shallow speaker, according to a preferred embodiment of the present invention.

FIG. 9 is a partial bottom plan view illustrating an exemplary embodiment of an exemplary diaphragm 800 for an exemplary novel shallow speaker 200, according to a preferred embodiment of the present invention. Channels 142 extend from first perforations 220 and across the underside surface 902 of top portion 216 of diaphragm 800 and underside surface 904 of depressed central annular region 402 to second perforations 222.

Figure 10:
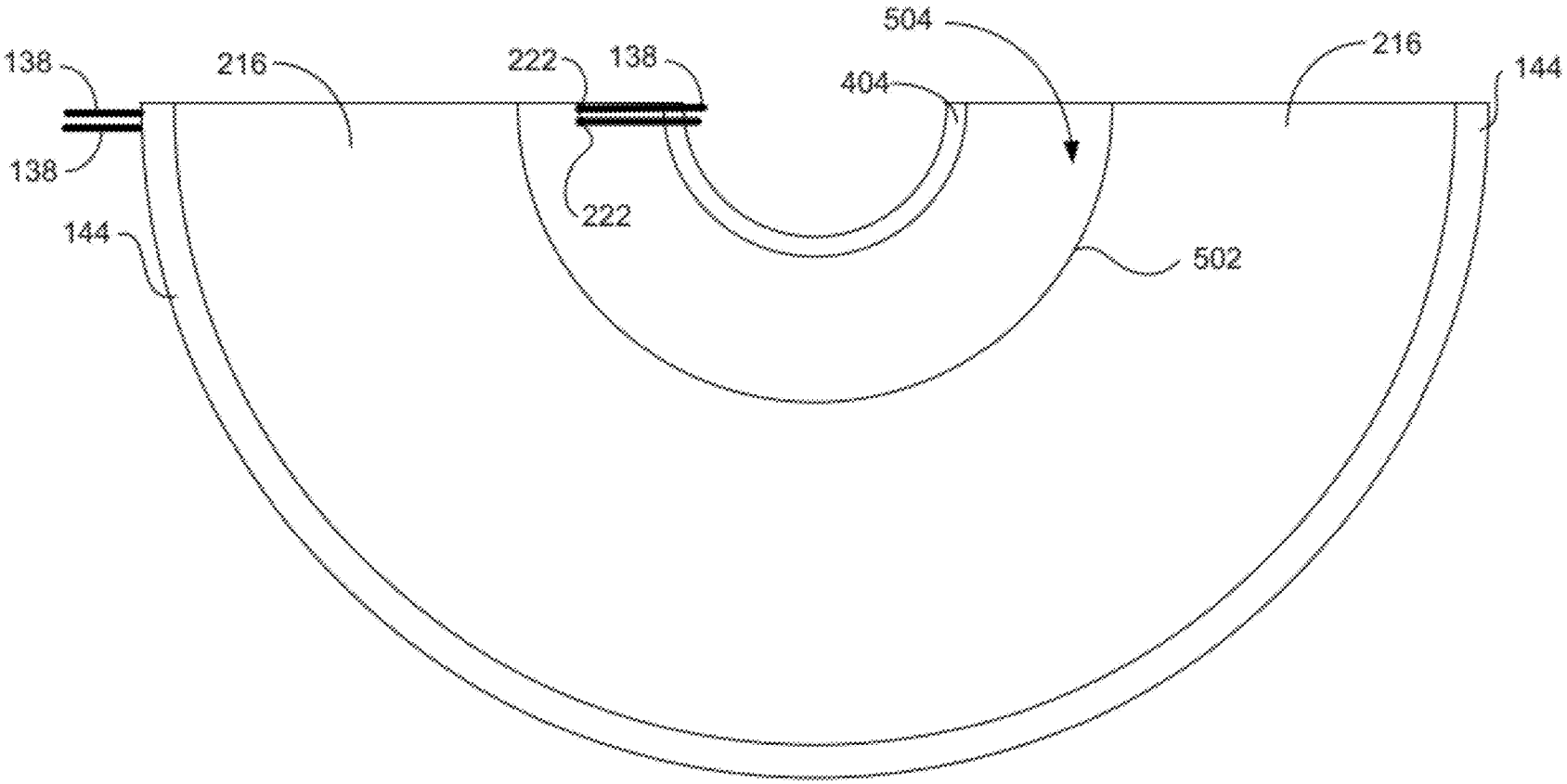
FIG. 10 is a partial top plan view illustrating the exemplary embodiment of the exemplary diaphragm for an exemplary novel shallow speaker, according to a preferred embodiment of the present invention, as shown in FIG. 9.

FIG. 10 is a partial top plan view illustrating the exemplary embodiment of the exemplary diaphragm 800 for an exemplary novel shallow speaker 200, according to a preferred embodiment of the present invention, as shown in FIG. 9. The top view of the tinsel 138 is shown, without the dust cap 130 covering the depressed central annular region 402.

Figure 11:
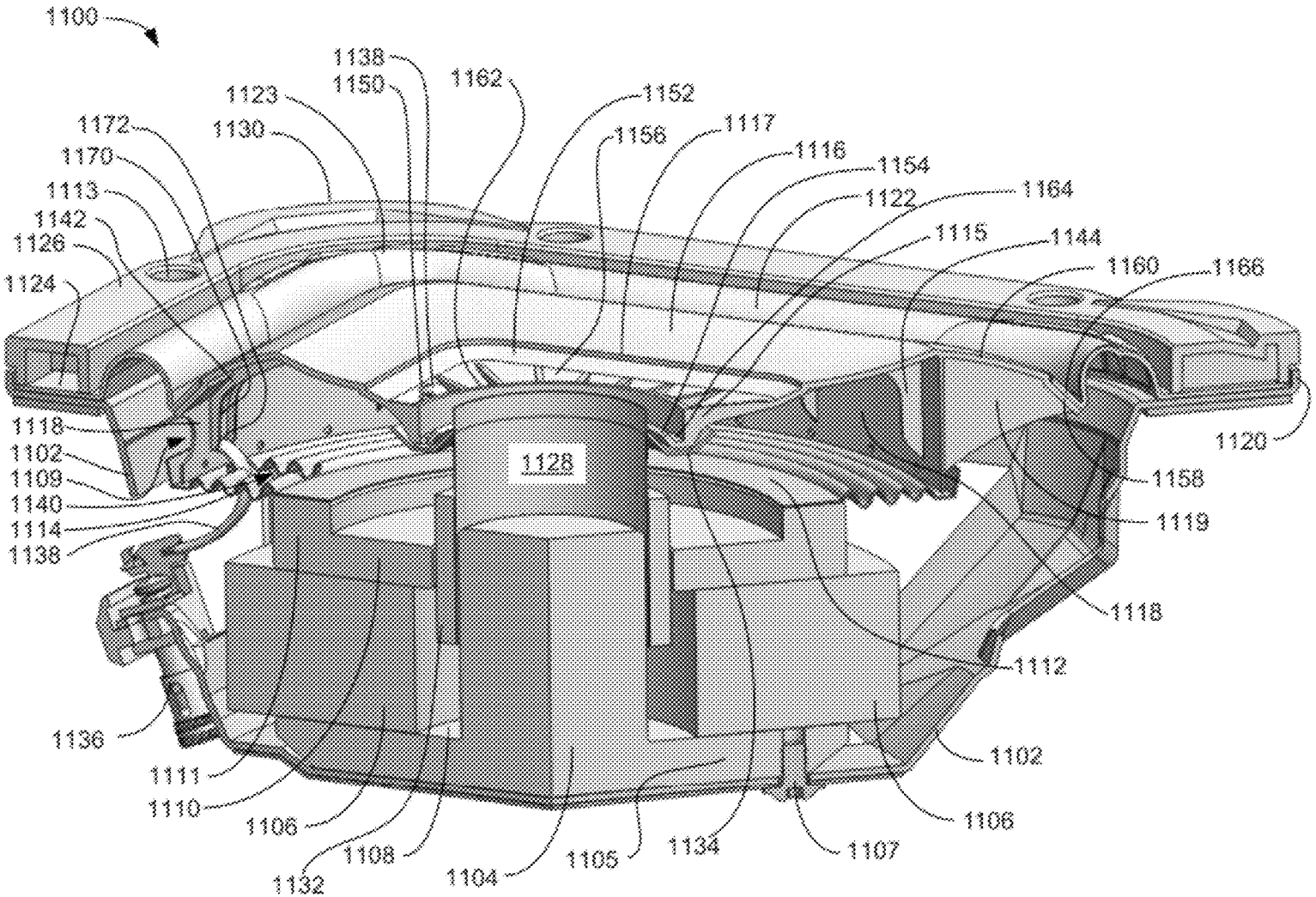
FIG. 11 is a sectional (A-A', see FIG. 12-13) cut-away top-side perspective view illustrating a fourth exemplary improved speaker, according to a fourth preferred embodiment of the present invention.

FIG. 11 is a sectional (A-A', see FIG. 12-13) cut-away top-side perspective view illustrating a fourth exemplary improved speaker 1100, according to a fourth preferred embodiment of the present invention. Fasteners 1107 fasten basket 1102 to annular flange 1105 of pole piece 1104 that supports annular magnet 1106 which, in turn, supports top plate 1110 having raised outer annular portion 1111. Annular magnet 1106, pole piece 1104, and top plate 1110 create gap 1108 in which coil 1132 moves freely in vertical directions. Coil 1132 is fixed to former 1128 which supports annular glue well 1134. Annular glue well 1134 is designed to fixedly receive inner diaphragm flange 1164. Inner diaphragm flange

1164 has an upwardly extending annular wall 1162 that supports central flanges 1115 extending radially outward over the inner square dust cap region 1156. Inner diaphragm flange 1164 includes inner diaphragm flange edge 1154, which may be covered in glue (not shown) when annular glue well 1134 is filled. Opening 1150 in inner square dust cap region 1156 admits tinsel 1138 from a channel 1142 under the diaphragm 1200 to connect (not shown) with the coil 1132. Dust cap glue surface 1152 is between the inner square dust cap region 1156, and dust cap ledge 1117, which is the inner boundary of diaphragm top surface 1116. Top diaphragm flanges 1144 support the diaphragm top surface 1116 against the cylindrical sub-cone 1118, which depends from the diaphragm 1200 (see FIG. 12). Cylindrical sub-cone 1118 is preferably has at least one vent 1109 to reduce pressure effects on the diaphragm 1200 during operation. Preferably, the diaphragm 1200, including the cylindrical sub-cone 1118, is made as a single piece of injection-molded ABS plastic. Improved speaker 1100 is a square speaker and is exemplary of cornered speakers generally, including both regular and irregular polygon-shaped speakers.

Diaphragm top surface 1116 extends into diaphragm outer surface 1160 which, near the corners 1130, is supported by outer diaphragm flanges 1119 that extend radially outward from the cylindrical sub-cone 1118 to the edge of the diaphragm outer flange 1158 that extends outwardly from the diaphragm outer surface 1160 to receive the inner flange 1166 of surround 1122. Surround 1122 is a resilient coupling between the diaphragm outer flange 1158 and the basket 1102 and has specially configured corner portions 1123. The coupling is accomplished at the basket 1102 by means of an outer surround flange 1124 being glued to rim 1120 of the basket 1102. Trim bracket 1126 is secured to surround gasket 1124 and rim 1120, and has openings 1113 aligned with similar openings in the outer surround gasket 1124 and in the rim 1120 to receive bolts, screws, or the like for fastening the speaker 1100 into a cabinet.

The bottom edge of cylindrical sub-cone 1118 is glued to the outer periphery of spider 1114. The inner annular spider flange 1112 is glued to the top surface of raised outer annular portion 1111 of top plate 1110. Terminal 1136 receives audio signals from an audio source (not shown) and couples it to the tinsel 1138. Tinsel 1138 is routed through spider opening 1140 in spider 1114 and through a first subcone opening 1172, proximate to the bottom of cylindrical subcone 1118, to the outside of cylindrical subcone 1118 and then through a second subcone opening 1170 to the inside of cylindrical subcone 1118 proximate the top edge of the cylindrical subcone 1118 and then through channel 1142 to opening 1150. Openings 1150, 1170 and 1172 preferably have smooth edges to reduce wear on the tinsel 1138 insulation.

In operation, coil 1132 receives an audio signal through the tinsel 1138 which creates a magnetic field in the coil 1132 that interacts with the magnetic field of the annular magnet 1106 to propel the coil 1132 and former 1128 up or down, as the audio signal provides, pushing or pulling the diaphragm 1200 to pressurize the air adjacent to its upper surface, thereby producing sound.

Figure 12:
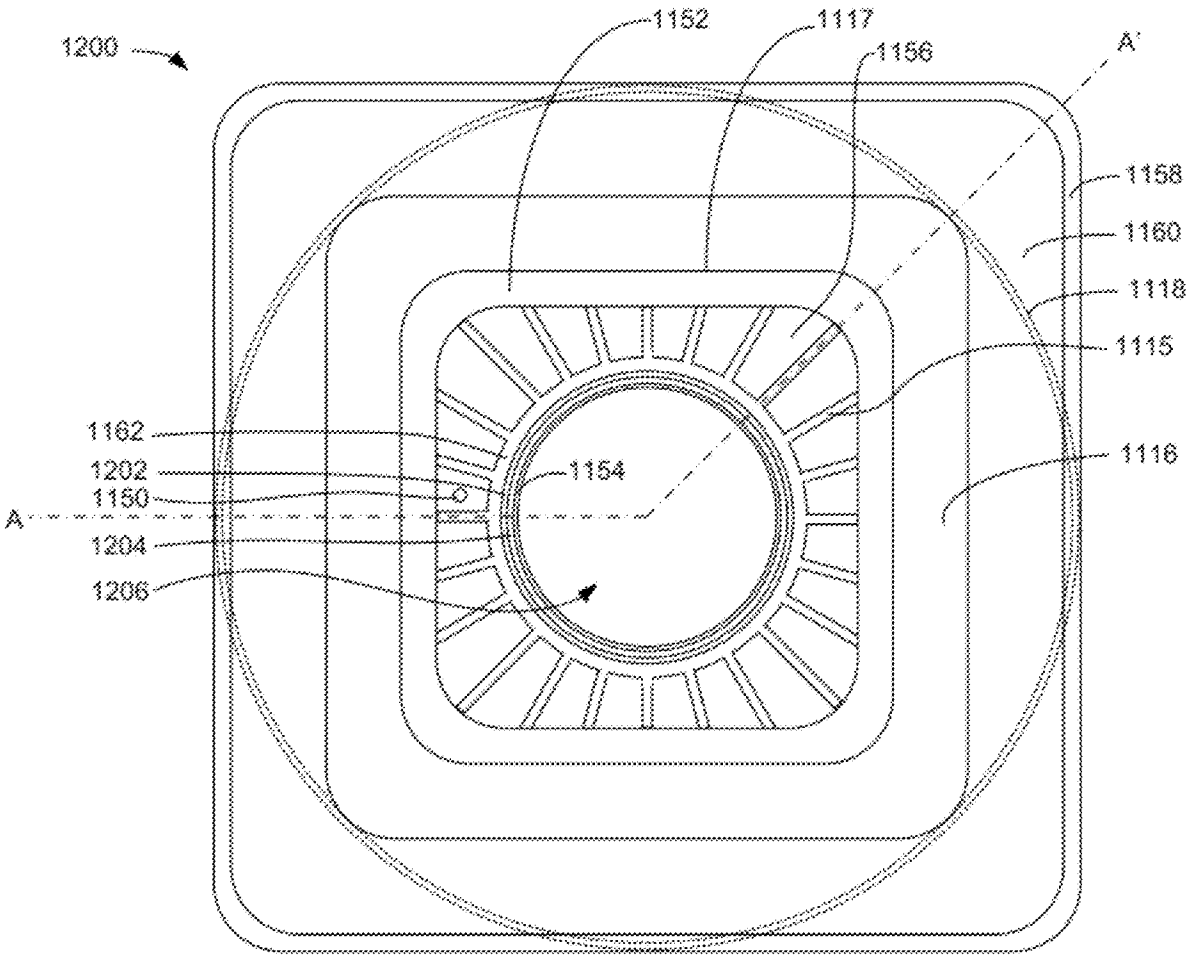
FIG. 12 is a top plan view illustrating the exemplary embodiment of the exemplary diaphragm for an exemplary novel shallow speaker showing section A-A', according to a preferred embodiment of the present invention, as shown in FIG. 11.

FIG. 12 is a top plan view illustrating the exemplary embodiment of the exemplary diaphragm 1200 for an exemplary novel shallow speaker 1100 showing section A-A', according to a preferred embodiment of the present invention, as shown in FIG. 11. Inner diaphragm flange 1164 includes upwardly extending annular wall 1162, glue channel 1202, sloping flange inner wall 1204 and inner flange edge 1154 surrounding central opening 1206. The section A-A' is the section used in FIG. 11. Opening 1150 is illustrated as circular but may, in various embodiments, be of any shape appropriate to the tinsel 1138 used.

Figure 13:
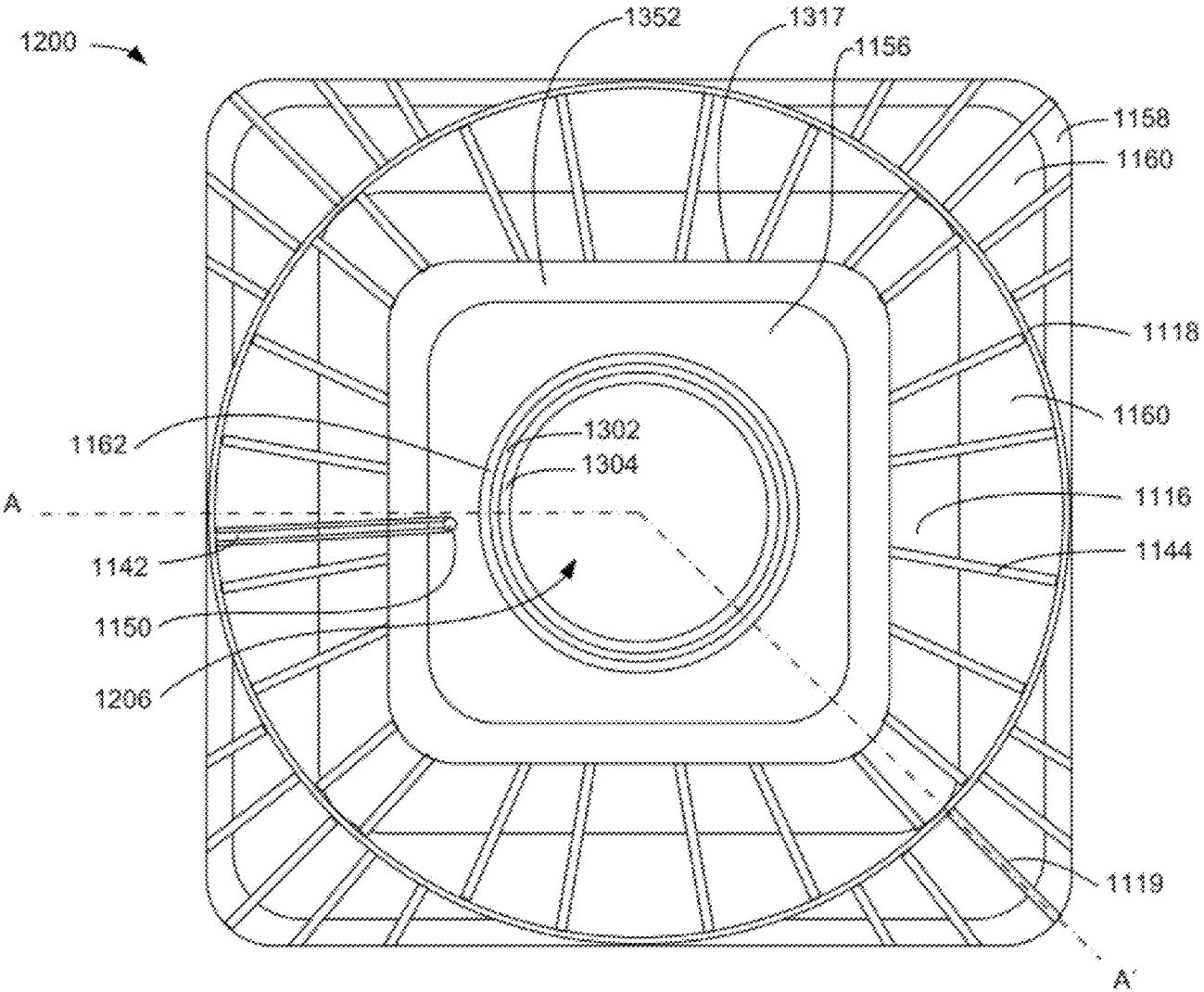
FIG. 13 is a bottom plan view illustrating the exemplary embodiment of the exemplary diaphragm for an exemplary novel shallow speaker showing section A-A', according to a preferred embodiment of the present invention, as shown in FIG. 11.

FIG. 13 is a bottom plan view illustrating the exemplary embodiment of the exemplary diaphragm 1200 for an exemplary novel shallow speaker 1100 showing section A-A', according to a preferred embodiment of the present invention, as shown in FIG. 11. Underneath, inner diaphragm flange 1164 appears as the bottom of upwardly extending annular watt 1162, bottom surface 1302, and die underside 1304 of sloping flange inner wall 1204. Top diaphragm flanges 1144 and outer diaphragm flanges 1119 can be seen in exemplary patterns. Top diaphragm flanges 1144 extend inward from cylindrical sub-cone 1118 and may, in various alternate embodiments, not reach the outer periphery 1317 of the underside 1352 of dust cap glue surface 1152. Channel 1142 may be made of parallel ridges, as shown or, in an alternate embodiment, may be a groove in the underside of diaphragm 1200.

Although applicant has described applicant's preferred embodiments of this invention, it will be understood that the broadest scope of this invention includes modifications such as diverse shapes, sizes, and materials. For example, and without limitation, the teachings of this disclosure may be applied to speakers of various shapes and sizes. Such scope is limited only by the below claims as read in connection with the above specification. Further, many other advantages of applicant's invention will be apparent to those skilled in the art from the above descriptions and the below claims.

What is claimed is:

1. An improved shallow speaker, wherein the improvement comprises a diaphragm comprising:

a. a top portion having an inner perimeter and an outer perimeter;

b. an outer perimeter portion sloped downwardly extending outward from said top portion outer perimeter;

c. a depressed central portion extending inwardly from said top portion inner perimeter and having an inner annular glue flange; and d. an annular cylindrical subcone depending from at least a portion of said outer perimeter portion and sized and positioned to engage an outer perimeter of a spider of said improved shallow speaker when assembled; and e. a top plate on an annular magnet, said top plate having a top surface and an inner spider flange, wherein said inner spider flange is operable to be adhered to said top surface of said top plate.

2. The improved shallow speaker of claim 1, wherein the improvement further comprises said top plate having a raised outer annular portion comprising a rounded top outer corner extending downward from said top surface.

3. The improved shallow speaker of claim 2, wherein:

a. said top plate comprises a pattern of threaded screw holes through said top surface;

b. a spider ring comprising:

i. a flat annular body sized to cover said top surface;

ii. an inner downward-depending flange extending from said flat annular body; and iii. a pattern of screw holes alignable to said pattern of threaded screw holes; and c. said inner spider flange comprising said pattern of screw holes alignable to said pattern of threaded screw holes;

d. wherein said inner spider flange is further secured to said top surface of said raised outer portion of said top plate with said spider ring secured over said inner spider flange with screws through said patterns of screw holes and into said pattern of threaded screw holes.

4. The improved shallow speaker of claim 1, the improvement comprising said diaphragm comprising at least one channel for securely routing a tinsel.

5. The improved shallow speaker of claim 1, wherein the improvement comprises said diaphragm comprising:

a. at least one first perforation in said annular cylindrical subcone; and b. at least one second perforation in said depressed central portion; wherein said at least one first perforation and said at least one second perforation are sized, shaped, and arranged to permit a tinsel to be threaded through said at least one first perforation and said at least one second perforation.

6. The improved shallow speaker of claim 1, wherein the improvement comprises a tinsel, wherein said spider comprises at least one spider tinsel opening sized, shaped, and arranged to permit said tinsel to be threaded through said at least one spider tinsel opening.

7. The improved shallow speaker of claim 1, wherein the improvement comprises said outer perimeter of said diaphragm top portion having a cornered shape.

8. The improved shallow speaker of claim 7, further comprising:

a. a plurality of support flanges connecting said annular cylindrical subcone to said diaphragm top portion;

b. said depressed central portion comprising an outer perimeter having a cornered shape;

c. said inner annular glue flange having an upwardly extending outer annular wall with a second plurality of support flanges extending radially outward from said upwardly extending outer annular wall across at least a portion of said depressed central portion.

9. The improved shallow speaker of claim 1, wherein the improvement comprises:

a. a spider comprising an outer annular spider flange coupled to a vertical annular spider flange; and b. an outer roll of said spider, forming a channel with said outer annular spider flange coupled to said vertical annular spider flange, wherein said channel is operable to receive a bottom edge of said annular cylindrical subcone and to adhere said bottom edge of said annular cylindrical subcone to said spider.

10. An improved shallow speaker, wherein the improvement comprises a diaphragm comprising:

a. a top portion having an inner perimeter and an outer perimeter;

b. an outer perimeter portion sloped downwardly extending outward from said top portion outer perimeter;

c. a depressed central portion extending inwardly from said top portion inner perimeter and having an inner annular glue flange;

d. an annular cylindrical subcone depending from said outer perimeter portion and sized and positioned to engage an outer perimeter of a spider of said improved shallow speaker when assembled; and e. at least one channel, that is formed one of along and into at least one surface of said diaphragm, for securely routing at least one tinsel; and f. a top plate on an annular magnet, said top plate having a top surface and an inner spider flange, wherein said inner spider flange is operable to be adhered to said top surface of said top plate.

11. The improved shallow speaker of claim 10, wherein the improvement further comprises said top plate having a raised outer annular portion comprising a rounded top outer corner extending downward from said top surface.

12. The improved shallow speaker of claim 11, comprising:

a. a pattern of threaded screw holes in said top plate through said top surface;

b. a spider ring comprising:

i. a flat annular body sized to cover said top surface;

ii. an inner downward-depending flange extending from said flat annular body; and iii. a pattern of screw holes alignable to said pattern of threaded screw holes; and c. said inner spider flange further comprising said pattern of screw holes alignable to said pattern of threaded screw holes;

d. wherein said inner spider flange is further secured to said top surface of said raised outer portion of said top plate with said spider ring secured over said inner spider flange with screws through said patterns of screw holes and into said pattern of threaded screw holes.

13. The improved shallow speaker of claim 10, wherein the improvement comprises said diaphragm comprising at least one first perforation in said annular cylindrical subcone, sized, shaped, and arranged to permit said at least one tinsel to be threaded through said at least one first perforation.

14. The improved shallow speaker of claim 10, wherein the improvement comprises said diaphragm comprising at least one second perforation in said depressed central portion, sized, shaped, and arranged to permit said at least one tinsel to be threaded through said at least one second perforation.

15. The improved shallow speaker of claim 10, wherein the improvement comprises said outer perimeter of said diaphragm top portion having a cornered shape.

16. The improved shallow speaker of claim 15, further comprising:

a. a first plurality of support flanges connecting said annular cylindrical subcone to said diaphragm top portion;

b. said depressed central portion comprising an outer perimeter further comprising a cornered shape;

c. said inner annular glue flange having an upwardly extending annular wall with a second plurality of flanges extending radially outward from said upwardly extending annular wall across at least a portion of said depressed central portion.

17. The improved shallow speaker of claim 10, wherein the improvement comprises:

a. a spider comprising an outer annular spider flange coupled to a vertical annular flange; and b. an outer roll of said spider forming a channel with said outer annular spider flange coupled to said vertical annular flange, wherein said channel is for receiving a bottom edge of said annular cylindrical subcone and adhering to said bottom edge of said annular cylindrical subcone.

18. An improved shallow speaker, wherein the improvement comprises:

a. a diaphragm comprising:

i. a top portion having an inner perimeter and an outer perimeter;

ii. an outer perimeter portion sloped downwardly extending outward from said top portion outer perimeter;

iii. a depressed central portion extending inwardly from said top portion inner perimeter and having an inner annular glue flange; and iv. an annular cylindrical subcone depending from said outer perimeter portion and sized and positioned to engage an outer perimeter of a spider of said improved shallow speaker when assembled;

v. at least one channel along at least one surface of said diaphragm for securely routing at least one tinsel;

vi. at least one first perforation in said annular cylindrical subcone, sized, shaped, and arranged to permit said at least one tinsel to be threaded through said at least one first perforation; and vii. at least one second perforation in said depressed central portion, sized, shaped, and arranged to permit said at least one tinsel to be threaded through said at least one second perforation;

b. a top plate on an annular magnet having a raised outer annular portion comprising:

i. a top surface;

ii. a rounded top outer corner extending downwardly from said top surface;

c. a spider comprising an inner annular spider flange adhered to said top surface of said raised outer annular portion of said top plate d. said spider comprising an outer annular spider flange coupled to a vertical annular flange; and e. an outer roll of said spider, forming a channel with said outer annular spider flange extending to said vertical annular flange for receiving and adhering a bottom edge of said annular cylindrical subcone.

19. The improved shallow speaker of claim 18, wherein the improvement comprises:

a. said outer perimeter of said diaphragm top portion comprising a cornered shape;

b. a plurality of support flanges connecting said annular cylindrical subcone to said outer perimeter portion of said diaphragm having an outer perimeter comprising a cornered shape;

c. said depressed central portion comprising an outer perimeter having a cornered shape;

d. said inner annular glue flange having an upwardly extending annular wall; and e. a second plurality of flanges extending radially outward from said upwardly extending annular wall over said at least a portion of said depressed central portion.

20. The improved shallow speaker of claim 18, comprising:

a. a pattern of threaded screw holes in said top plate and through said top surface;

b. a spider ring comprising:

i. a flat annular body sized to cover said top surface;

ii. an inner downward-depending flange extending from said flat annular body; and iii. a pattern of screw holes alignable to said pattern of threaded screw holes; and c. said inner spider flange further comprising said pattern of screw holes alignable to said pattern of threaded screw holes;

d. wherein said inner spider flange is further secured to said top surface of said raised outer portion of said top plate with said spider ring secured over said inner spider flange with screws through said patterns of screw holes and into said pattern of threaded screw holes.

* * * * *